US005080004A

United States Patent [19]

Francis et al.

[11] Patent Number: 5,080,004

[45] Date of Patent: Jan. 14, 1992

[54] CLEAN-OUT PIPE RECEPTACLE

[75] Inventors: Thomas Francis, Fraser; K. Rand Dykman, Armada, both of Mich.

[73] Assignee: Superior Environmental Service, Inc., Armada, Mich.

[21] Appl. No.: 487,280

[22] Filed: Mar. 2, 1990

Related U.S. Application Data

[60] Continuation-in-part of Ser. No. 335,878, Apr. 10, 1989, Pat. No. 4,981,150, which is a division of Ser. No. 182,178, Apr. 15, 1988, Pat. No. 4,848,380.

[51] Int. Cl.[5] ..... F24F 7/06; F24F 11/00

[52] U.S. Cl. ..... 454/341; 52/169.5; 405/43; 454/344

[58] Field of Search ..... 98/42.02, 42.06; 52/169.5; 405/43, 51

[56] References Cited

U.S. PATENT DOCUMENTS

| | | | |
|---|---|---|---|
| 2,768,949 | 10/1956 | Hewey | 210/6 |
| 3,007,186 | 11/1961 | Olsson | 15/104.3 |
| 3,370,599 | 2/1968 | Ciaccio | 134/167 |
| 3,658,589 | 4/1972 | Shaddock | 134/10 |
| 3,814,330 | 6/1974 | Masters | 239/558 |
| 4,073,302 | 2/1978 | Jones | 134/167 C |
| 4,391,551 | 7/1983 | Belcher | 405/43 |
| 4,756,324 | 7/1988 | Larsson | 134/167 C |
| 4,773,113 | 9/1988 | Russell | 15/4 |
| 4,798,034 | 1/1989 | Jarnagin et al. | 98/42.02 X |
| 4,838,768 | 6/1989 | Flaherty | 417/308 |
| 4,949,626 | 8/1990 | Townsend et al. | 98/42.02 |

FOREIGN PATENT DOCUMENTS 564489 10/1958 Canada .

OTHER PUBLICATIONS

"Radon Reduction Techniques for Detached Houses", Technical Guidance, EPA/625/5-86/019, U.S. Environmental Protection Agency, Jun. 1986.

"Halliburton's Line Mole Cleaning Process . . .", *Chemical Engineering* (Oct. 23, 1967) @ p. 89.

*Primary Examiner*—Harold Joyce

*Attorney, Agent, or Firm*—Gerald R. Black

[57] ABSTRACT

The system for removing the soil gas from the ground surrounding the building structure, includes a clean-out receptacle, an air duct system, and a fan. The clean-out pipes are installed inside the building structure, accessible from the ground level and near junctions between the interconnecting pipes and the drain tile. The air duct system is securable to a clean-out receptacle, and the fan is installed inside the air duct. The air duct system is disconnected from the clean-out receptacle during the cleaning of the drain tile system. The pressurized fluid projecting through the tip of the rocket nozzle, removes any obstructions in the drain tile, and the pressurized fluid projecting rearward from the nozzle, propels the rocket nozzle through the drain trail system. The air duct system is then connected to the clean-out pipe. The operation of a fan in the air duct system create a negative pressure and vents soil gas from the ground surrounding the building structure which draws the soil gas into and through the porous drain tile. By continuously operating the fan, the soil gas is effectively prevent from entering the building structure.

14 Claims, 4 Drawing Sheets 60
50
46
49
48
18
44
14
66
10
22

CLEAN-OUT PIPE RECEPTACLE

CROSS-REFERENCE TO RELATED APPLICATIONS

This is a continuation-in-part of copending application Ser. No. 335,878 filed on Apr. 10, 1989 now U.S. Pat. No. 4,981,150, which is a division of application Ser. No. 182,178 filed on Apr. 15, 1988 now U.S. Pat. No. 4,848,380 the disclosures of which are both hereby incorporated by reference.

BACKGROUND OF THE INVENTION

1. Field of the Invention

The present invention relates to a new apparatus that is useful in cleaning drain tile, and for removing soil gas from the ground surrounding a building structure in a safe and effective manner.

2. Background Art

Conventional dwellings and other building structures are typically built upon foundation walls which define the basement area. Most such building structures have an existing drain tile system in the immediate proximity of the foundation, which enable water and debris immediately surrounding the building structure to drain therethrough.

The drain tile system is generally located around the perimeter of the building structure slightly below the foundation, either directly under the perimeter of the building structure, or immediately surrounding the perimeter of the building structure. The drain tile system is made of a water porous tile and is laid in a continuous channel, so that water and contaminants disposed in the vicinity of the building structure can be routed across and through the drain tile system and into a sewer or a sump pump. The drain tile system is generally in fluid communication with a series of interconnecting pipes disposed underneath the building structure. Generally, these interconnecting pipes have gradual bends in the direction of fluid flow and are accessible through several floor drains located in the basement floor of the building structure. A piping system generally includes the series of interconnecting pipes and all other piping disposed within the building structure that is in fluid communication with the interconnecting pipes.

Radon is an invisible odorless gas produced by the natural decay of uranium in the soil. The Center for Disease Control has reported that human exposure to radon gas is the primary cause of lung cancer, except for cigarettes. Such human exposure routinely occurs from radon that seeps from the ground into residences and other building structures. Scientists estimate that 20,000 Americans die annually as a result of radon exposure.

It has recently been estimated that one home in three may contain dangerous levels of radon gas. The EPA has set a recommended level for remedial action at 4 picocuries per liter, which is equivalent to 200 chest x-rays per year. Even at this level, almost 5 people out of 100 exposed to high levels of radon will die of radon-induced lung cancer.

Soil ventilation draws soil gas away from the building structure. The suction of soil gas through the drain tile system may be enhanced by a fan which suctions the soil gas from the soil around the foundation and through the drain tile system, effectively preventing the soil gas from entering the building structure. Drain tile suction is an inexpensive and nonobtrusive method of active soil ventilation, and such systems have demonstrated reductions in radon gas as high as 99%. For drain tile suction to be effective, it is critical that the drain tile system must be maintained free from objects which tend to block the normal flow of water and prevent ventilation of the drain tile system.

Oftentimes, the drain tile system is interconnected to the eaves wherein leaves and twigs, roof tar, and even the remains of small animals may become lodged. Since the flow of water and debris through the drain tile is at most a trickle, the drain tile is never thoroughly flushed. When the drain tile becomes blocked at various locations with debris, the drain tile system is extremely difficult to clean. The property owner is confronted with choosing between:

(a) digging several feet deep into the land surrounding the building structure to access the existing drain tile system, to locate and remove the blockages; or (b) inserting a second drain tile system underneath the building structure, and thereby jackhammering major portions of the existing building floor.

What is needed is new structure for cleaning and maintaining the existing drain tile that overcomes the disadvantages already noted, and enables the continuous soil ventilation through the drain tile system to remove soil gas from the vicinity of a building structure.

SUMMARY OF THE INVENTION

Thomas Francis and K. Rand Dykman have invented a new method of cleaning drain tile systems, by using a rocket nozzle attached to a flexible tubing with highly pressurized water (preferably 2200 to 5200 psi) propelling the rocket nozzle through the drain tile system, and removing blockages and other debris therefrom.

The clean-out pipe receptacle is installed proximate to a junction between the interconnecting pipe and the drain tile system, the reservoir being accessible from inside the building structure.

The clean-out pipe receptacle is then secured to an air duct system. A fan installed proximate to the air duct system creates a negative pressure in the drain tile system, which draws the soil gas into and through the drain tile system and safely enables the soil gas to be vented to the atmosphere about the building structure.

The clean-out pipe receptacle is critical in enabling blockages and debris to be effectively removed from the existing drain tile, while not damaging the landscape around the building structure, the landscape about the building structure, or the drain tile. Accordingly, the hidden drain tile system can be located, and an accessing system can be installed that can be permanently used as thereafter needed for cleaning the drain tile system and removing soil gas from the building structure. The system accesses the drain tile system at several discrete locations, enabling blockages to be cleared from anywhere in the drain tile system. Hence, the inside surface of the drain tile system can be effectively cleaned and soild gas can be continuously ventilated therethrough.

The present invention effectively enables soil gas to be removed from the ground surrounding a building structure. The system includes a clean-out pipe, an air duct system, and a fan. One or more clean-out pipes are disposed near the junctions between the piping systems and the drain tile system, the piping systems being disposed underneath the building structure. Preferably, the clean-out pipes are disposed inside the building structure, and are accessible from the floor of the lowermost level of the building structure. The air duct system is in fluid communication with the clean-out pipe. The air duct system is vented to atmosphere outside the building structure. The air duct system is securable to a clean-out pipe, and the fan is preferably installed inside the air duct system. The fan enables soil gas surrounding the building structure to be drawn through the drain tile system, through the clean-out pipe, through the air duct system, and safely to atmosphere surrounding the building structure.

The position of the junctions between the piping system and the drain tile system are preferably located by inserting a rocket nozzle into a centralized drain in the basement floor. The rocket nozzle is propelled through the piping system, and the nozzle will stop at the junction between the piping system and the drain tile. The position of the rocket nozzle is located through the floor of the building structure by the sound that the fluid makes escaping from the rocket nozzle. The clean-out pipes are then installed into the floor of the building structure in the vicinity of the junction.

The air duct system is preferably disconnected from the clean-out pipe during the cleaning of the drain tile system. The pressurized fluid projecting through the tip of the rocket nozzle removes any obstructions in the drain tile, and the pressurized fluid projecting rearward from the nozzle, propels the rocket nozzle through the drain tile in a forward direction and washes the debris through the drain tile system.

After the debris has been cleaned from the drain tile system, the air duct system is reconnected to the drain tile and the fan is energized. A negative pressure in the drain tile system draws the soil gas surrounding the drain tile system into the porous drain tile. By continuously operating the fan, the air in the drain tile system is vented through the air duct system and to atmosphere above the building structure, and the soil gas is effectively prevented from entering the building structure.

For a more complete understanding of the clean-out pipe reservoir of the present invention, reference is made to the following detailed description and accompanying drawings in which the presently preferred embodiments of the invention are illustrated by way of example. As the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

DETAILED DESCRIPTION OF THE INVENTION

Figure 2:
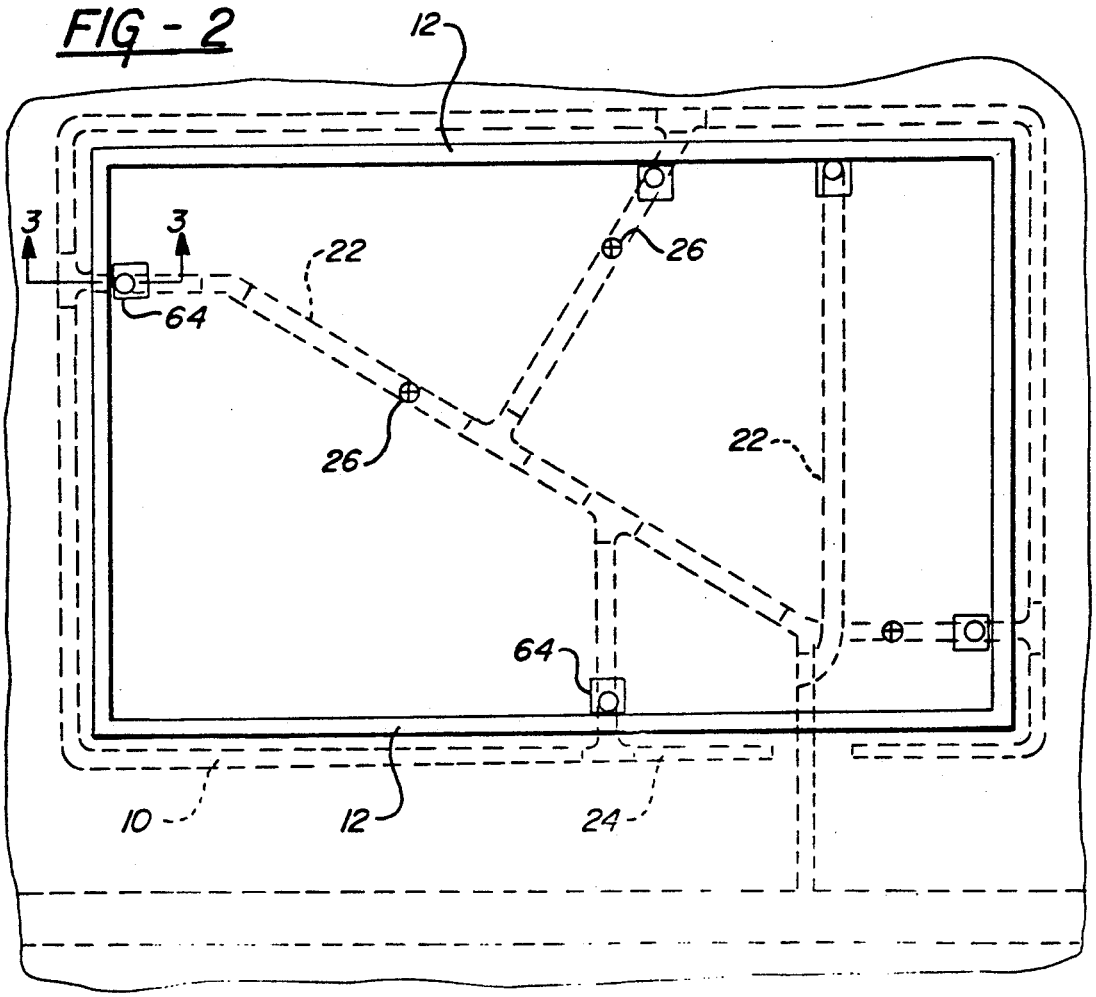
FIG. 2 is a plan view of the drain tile system of FIG. 1 located around the perimeter of a building structure.

Referring now to the drawings, a conventional drain tile 10 is shown in FIG. 2 which surrounds the perimeter of the building structure 12. It is to be understood, however, that the principles of this invention are equally applicable to any foundation drain tile system, including a drain tile that is located underneath the perimeter of the basement 14, and that the system depicted in FIG. 2 is used only for purposes of illustration.

The drain tile 10 is conventionally situated relative to the building structure 12 so that any water that collects in the vicinity of the building structure 12 is routed across and into the drain tile 10. The drain tile 10 is water porous and is laid in a continuous channel that feeds into either a sump pump or a centralized sewer. The drain tile 10 is generally in fluid communication with a piping system 22. The piping system 22 is affixed to the drain tile 10, at a series of junctions 24, the piping system 22 being disposed underneath the floor 14 of the building structure 12. The plurality of junctions are required by building codes to minimize blockages in the drain tile. Generally, the piping system 22 has gradual bends in the direction of fluid flow, the piping system 22 being accessible through one of several floor drains 26 located in the floor 14 of the building structure. The piping system 22 can be extremely useful in cleaning the drain tile 10, as will be hereinafter described.

Figure 1:
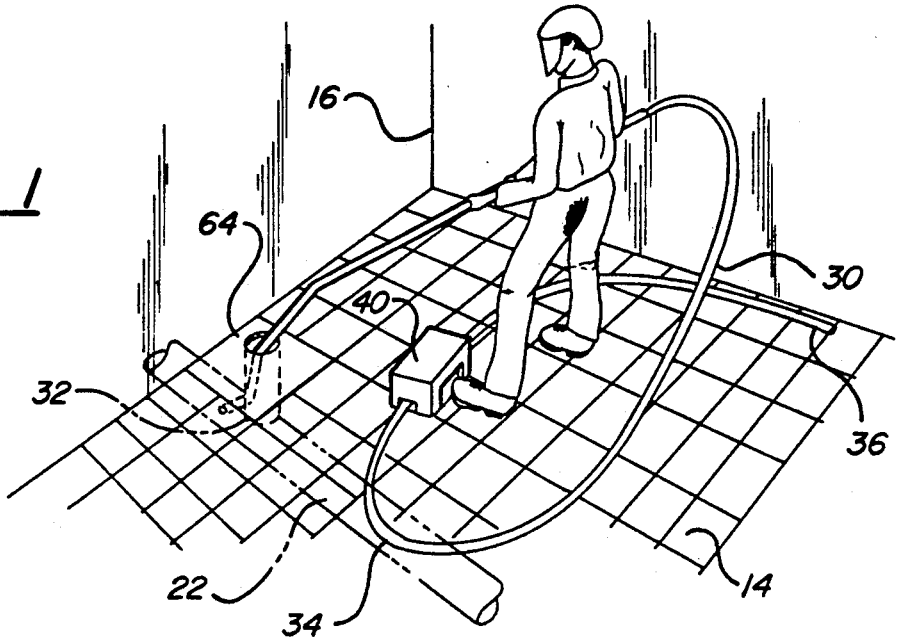
FIG. 1 is a perspective view of an operating system of the present invention using a high pressurized fluid system to clean a foundation drain tile system.

FIG. 1 shows a perspective view of a foundation drain tile cleaning apparatus 30. The apparatus 30 consists of a rocket nozzle 32 in fluid communication with flexible tubing 34, a high pressure fluid supply 36, and a foot pedal control valve 40 for starting and stopping the fluid flow.

Figure 4:
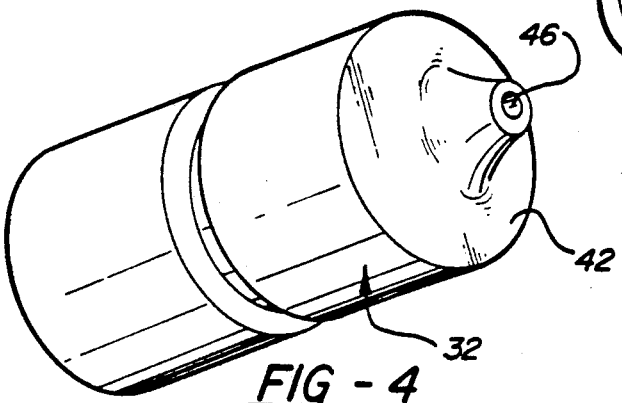
FIG. 4 is a detailed perspective view of the rocket nozzle depicted in FIG. 1.
Figure 4A:
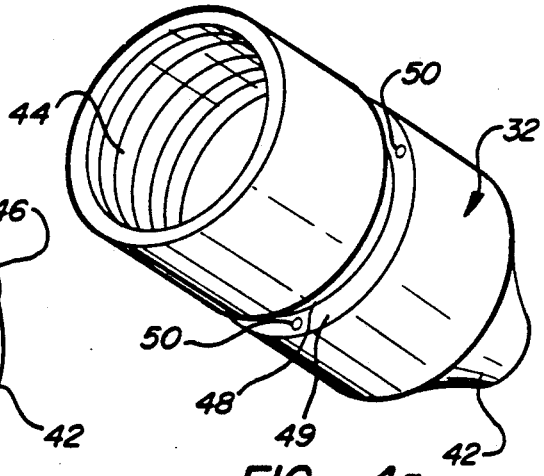
FIG. 4A is another detailed perspective view of the rocket nozzle depicted in FIG. 4.

The rocket nozzle 32 (as depicted in FIGS. 4 and 4A) is made of tool steel, and has a head portion 42 and a tail portion 44. The high pressure waterblast nozzles 32 are commercially available from the NLB Corporation, and are designed as Part Number P-4 10K. The head portion 42 has an opening 46 on the tip thereof through which pressurized fluid, preferably water, is dischargeable in the forward direction. The tail portion 44 of the rocket nozzle 32 is in fluid communication with a high pressure water supply. The rocket nozzle 32 has a recess 48 between the head portion and the tail portion, the recess having a rearward projecting surface 49. At least two apertures 50 are disposed in a rearward direction along the recess 48. The water propelled through the apertures 50 serves the dual function of propelling the cleaning apparatus 30 through the drain tile 10, and cleaning the inside surface of the drain tile 10.

The greater the number of rearwardly disposed apertures 50, the greater will be the propelling force applied to move the nozzle 32 through the drain tile 10, but the lesser will be the force of the water jet projected from the tip 46 of the rocket nozzle 32. Similarly, the fewer the number of rearwardly disposed apertures 50, the lesser will be the propelling force, but the greater will be the force of the water jet projected through the tip 46 of the rocket nozzle 32. The operator will usually have to use more than one rocket nozzle 32 to locate the junctions 24 and to clean the complete drain tile 10, depending upon the remoteness of the locations of the blockages in the line. Generally, the cleaning of the debris from the inside the drain tile 10 is completed by using a rocket nozzle 32 with no tip opening 46, so that the pressure of the water projecting from the apertures 50 is maximum.

The flexible tubing 34 is capable of withstanding the flow of high pressure water. The flexible tubing 34 is secured to the rocket nozzle 32 by fittings that are capable of withstanding high pressure water flow. The flexible tubing 34 is in fluid communication with the rocket nozzle 32. Water at a pressure between 2200 and 5200 psi is supplied to the tubing 34. A pump (not shown) of standard design that is well known in the art (see, for example, U.S. Pat. No. 4,838,768, the disclosure of which is incorporated herein by reference) is connected to the tap water to raise the supply pressure of the water to the desired range. A high pressure supply line is used to connect the water pump to the foot pedal control valve 40. The flow rate of water through the rocket nozzle 32 is about 4.5 gallons/minute.

Figure 5:
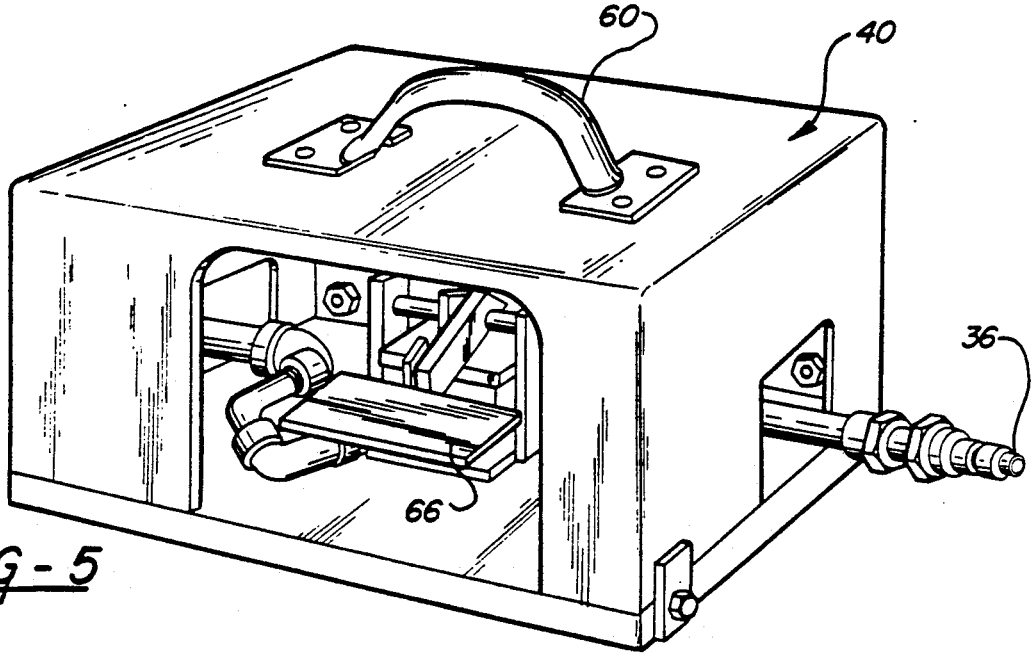
FIG. 5 is a detailed perspective view of the foot pedal control valve shown in FIG. 1.

FIG. 5 depicts the on-off foot pedal control valve 40, which is used to start and stop the water flow into the tubing 34 and into the rocket nozzle 32. The operation of the foot control valve 40 is similar to the operation of a gun, except that the valve 40 is operated by a foot pedal instead of a hand lever. The unit is preferably lightweight and portable, having a handle 60 for the easy transporting thereof.

The foot control valve 40 receives pressurized water through a supply line 62. The supply line 62 is in fluid communication with an output line 63, the output line 63 being insertable into the drain tile 10 to be cleaned. The foot control valve 40 has a lever 66 which is actuated by a foot of the operator, the lever 66 being preferably spring-actuated. When fluid is flowing through the foot control valve 40, actuation of the lever 66 by the operator will terminate fluid flow to the output line 63. When fluid is not flowing through the foot control valve 40 but is being provided through the supply line 62, actuation of the lever 66 by the operator will initiate fluid flow to the output line 63. By operating the foot control valve 40 with his foot, the operator has both hands free to manipulate the flexible tubing 34 into and through the drain tile 10. Also, for prolonged usage of the cleaning apparatus 30, it is considerably easier for an operator to apply pressure with his foot than with his hand. The operator must always be in in control of the flexible tubing 34 and the rocket nozzle 32, particularly when the rocket nozzle 32 is disposed close to the entry of the drain tile 10, because of the risk of personal injury from the high pressure water.

As pressurized water is supplied to the rocket nozzle 32, the water is projected rearwardly through the apertures 50, propelling the rocket nozzle 32 in a forward direction through the drain tile 10. The flow of the pressurized water through the rocket nozzle 32 causes the pressurized water to be projected through the tip opening 46 in the rocket nozzle 32. As the rocket nozzle 32 is propelled through the drain tile 10, the water flowing through the nozzle tip 46 is continually directed at the debris with sufficient force to separate the debris from the drain tile 10. The water serves the dual function of separating the debris from the drain tile 10 and washing the debris through the drain tile 10 into either a sump pump or a central sewer.

This cleaning method can be used to clean the foundation drain tile 10 by first locating the position of the junctions 24 of the piping systems 22 with the drain tile 10. The piping system 22 is in fluid communication with the drain tile 10 at a series of junctions 24.

First, the position of each junction 24 is determined by inserting the rocket nozzle 32 of the cleaning apparatus 30 depicted in FIG. 1 into a centralized drain 26 in the building structure 12. The rocket nozzle 32 is in fluid communication with a high pressure fluid supply line 36. The rocket nozzle 32 is propelled through the piping system 22 when the cleaning apparatus 30 is energized. The rocket nozzle 32 will stop at the junction 24 between the piping system 22 and the drain tile 10, since the rocket nozzle 32 cannot ordinarily overcome the radical bends that generally exists between the piping system 22 and the drain tile 10. Also, the pressure in the supply line 36 can be maintained at a low enough level to regulate the movement of the rocket nozzle 32 around these corners. The operator can overcome the radical bends in the piping system 22 and the drain tile 10 with a rapid series of bursts on the lever 66 of the foot pedal control valve 40 coupled with his twisting and turning the flexible tubing 34 relative to the drain tile 10. The position of the rocket nozzle 32 is located through the floor of the building structure 12 by the sound of the fluid escaping from the rocket nozzle 32.

Figure 3:
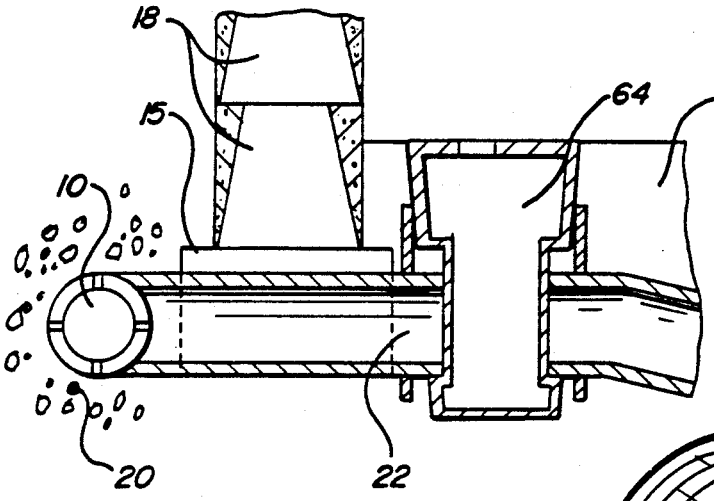
FIG. 3 is a sectional side view depicting a junction of the drain tile and interconnecting piping system of FIG. 2.

Once the position of a junction 24 is located, a cleanout receptacle 64 is inserted into the floor 14 of the building structure 12 by digging through the floor 14 in the vicinity of the junction 24. The cleanout receptacle 64 is installed into the interconnecting pipe 22. The cleanout receptacle 64 is preferably located just inside the foundation sidewalls 16, and located so that it is accessible from the floor 14 of the building structure 12 for subsequent cleaning and maintenance of the drain tile 10. As shown in FIG. 3, the cleanout receptacles 64 are preferably joined to the interconnecting pipes 22 underneath the building structure 12 near each junction 24 along each wall of the building structure 12.

Once the cleanout receptacle 64 is installed into the piping system 22 near a junction 24, the rocket nozzle 32 is inserted at least sixteen inches into the cleanout receptacle 64. The operator then depresses the foot pedal control valve 40, which enables the water to be directed into the rocket nozzle 32. The sixteen inch point on the flexible tube 34 is marked with tape, so that it can be easily recognized when the rocket nozzle 32 is withdrawn from the drain tile 10. As pressurized fluid is projected through the nozzle apertures 50 in a rearward direction, the rocket nozzle 32 is propelled through the drain tile 10 in a forward direction. As pressurized fluid is projected through the nozzle tip opening 46 in a forward direction, the jet spray separates the debris from the drain tile 10.

Figure 6:
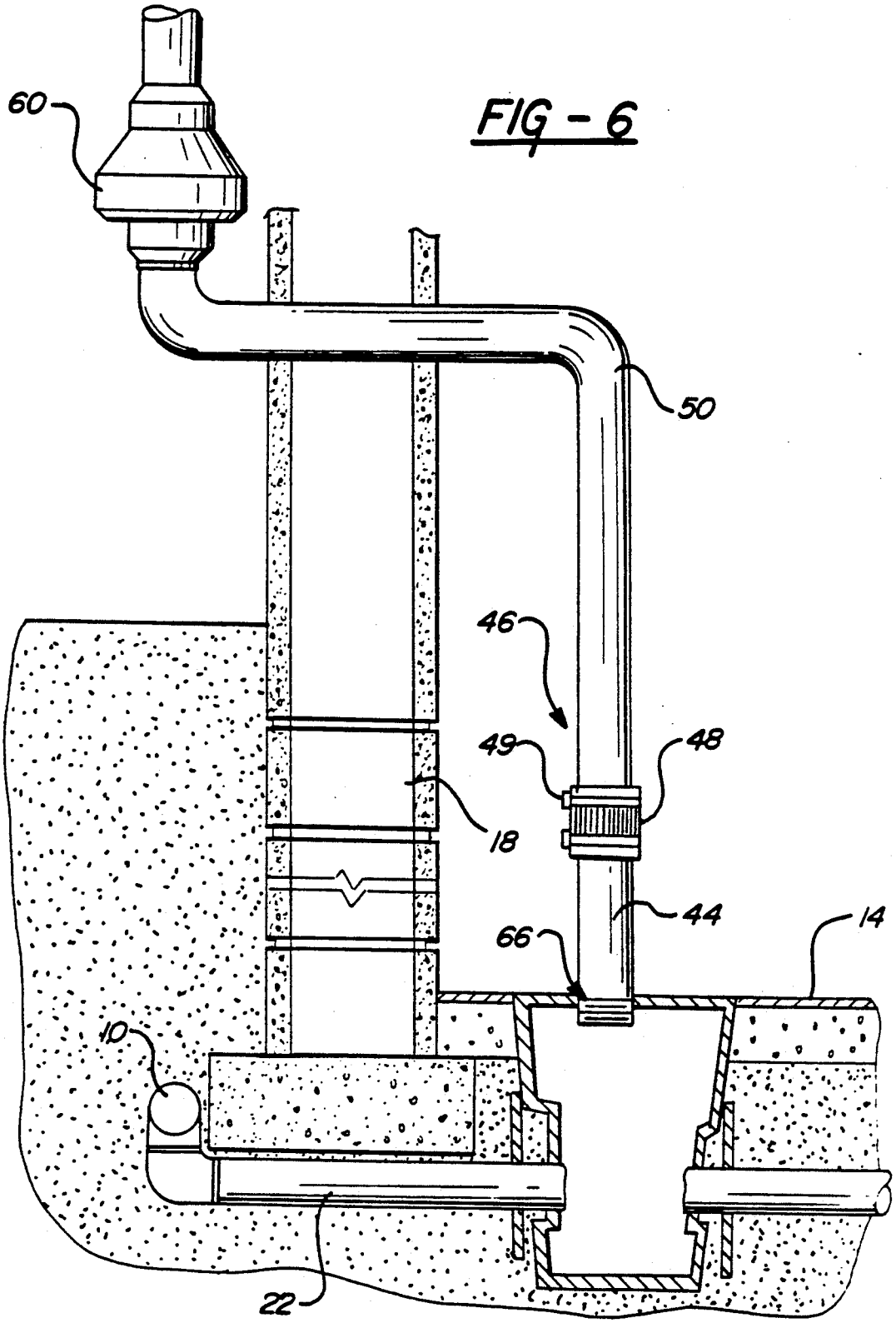
FIG. 6 is an enlarged cross-sectional view of one embodiment of the air duct system and fan, the air duct system being engaged with the clean-out pipe.

The system 66 for removing the soil gas from the ground surrounding the building structure 12, includes a clean-out receptacle 64, an air duct system 46, and a fan 60, (see FIG. 6). The water porous drain tile 10 will not effectively remove the soil gas from the ground surrounding the building structure 12 if:

(a) there are blockages in the drain tile 10 which prevent a portion of the drain tile 10 from venting through the clean-out receptacle 64 and the air duct system 46; or (b) debris is allowed to build up along the inside surface of the drain tile 10 preventing the soil gas to be drawn into the drain tile 10 by the negative pressure of the fan 60.

Accordingly, regular cleaning and maintenance of the drain tile 10 is required if soil gas is to be vented through the drain tile 10.

In the embodiment, as shown in FIG. 6, the clean-out receptacle 64 is disposed proximate to the junctions 24 between the interconnecting pipes 22 and the drain tile 10 (see FIG. 6). The clean-out receptacle 64 shown herein is four inch Schedule 40 pipe, and is in fluid communication with both the drain tile 10 and a piping system 22. Preferably, a clean-out receptacle 64 is installed at each junction between the interconnecting pipe 22 and the drain tile 10, the clean-out receptacle 64 being disposed inside the building structure 12, and accessible from the ground level. To remove blockages from the drain tile 10, the rocket nozzle 32 is preferably inserted into the drain tile 10 through the clean-out receptacle 64 as has been already described herein.

Once the position of a junction 24 is located, the floor 14 of building structure 12 is cut away, and the receptacle is cleaned of sand and stone. A segment of the piping system 22 is then cut at a predetermining distance, and the segment is removed and disposed of. Two backup plates 71, each plate having a hole disposed therein that is barely larger than the outer diameter of the pipe 22, are then installed one plate about the end of each pipe. Holes are then cut into opposite sides of the flat portion 73 of the clean-out receptacle 64, and the clean-out receptacle 64 is then slid into place into the floor 14, with the two pipes 22 protruding thereunto, and the backup plates 71 positioned in a general vertical alignment against clean-out receptacle 64. The cavity about the clean-out receptacle is then filled with sand and stone, and concrete is poured into the floor 14 about the clean-out receptacle. The cover is then inserted into the clean-out receptacle 64.

The air duct system 46 as described herein preferably includes a duct segment 44, a primary duct 50, and a boot 48 and two stainless steel clamps 49 (see FIG. 6). The air duct system 46 is mounted and attached to a clean-out receptacle 64 as shown in FIG. 6. The duct segment 44 is preferably PVC, Schedule 40 piping that is about four inches long. The air duct boot 48 and the pipe boots 88 are preferably Fernco rubber couplings. By placing the air duct system 46 in fluid communication with the drain tile 10, air from inside the drain tile 10 can be circulated into and through the air duct. The duct segment 44, the boot 48, and the clamps 49 can be quickly and readily disconnected from the clean-out receptacle 64, enabling the rocket nozzle 32 to be inserted therein during the cleaning and maintaining of the drain tile 10. The air duct system 46 is vented to the air outside, and preferably above the building structure 12.

The top end portions of all of the clean-out receptacles 64 may be threaded, so that a cover plate 71 may be inserted therein when the drain tile 10 is not being cleaned. The pipe caps 71 are preferably generally flush with the floor of the building structure 12. The clean-out receptacle 64 that is to be connected to the air duct system 46 may be threadably engaged with the duct segment 44. The rubber boot 48 is subsequently clamped over the top portion of the duct segment 44 and the primary duct 50, to prevent the soil gas from leaking into the building structure 12, during the continuous venting of the drain tile 10. When the drain tile 10 is to be periodically flushed and cleaned by means of the rocket nozzle 32 and the high pressure water, the clamps 49 are removed, the duct segment 44 is unthreaded from the clean-out receptacle 64, and the rocket nozzle 32 is inserted into the clean-out receptacle 64.

The fan 60 is disposed above the ground level. The fan 60 is disposed proximate to the primary duct 50, and preferably in the primary duct 50 and near the drain tile 10 about two feet from the basement floor 14. The fan 60 enables the soil gas to be drawn into the porous drain tile 10, and to circulate into and through the clean-out receptacle 64, and the air duct system 46, where it is vented to the atmosphere over the building structure 12.

The cleaning and the flushing of debris from the drain tile 10 creates a negative pressure in the drain tile 10. This negative pressure draws the soil gas from the ground surrounding the drain tile 10 and into the porous drain tile 10. By continuously venting the air in the drain tile 10 through the air duct system 46 and to atmosphere above the building structure 12, any contaminants in the ground air surrounding the drain tile 10 are effectively removed therefrom.

Figure 7:
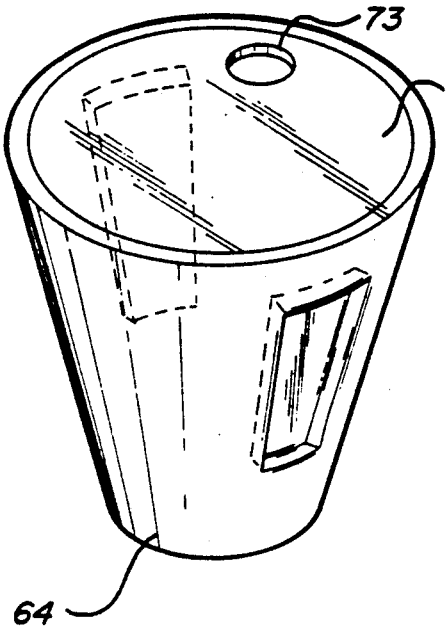
FIG. 7 is an isometric view of the preferred embodiment of the present invention of the clean-out receptacle.
Figure 8:
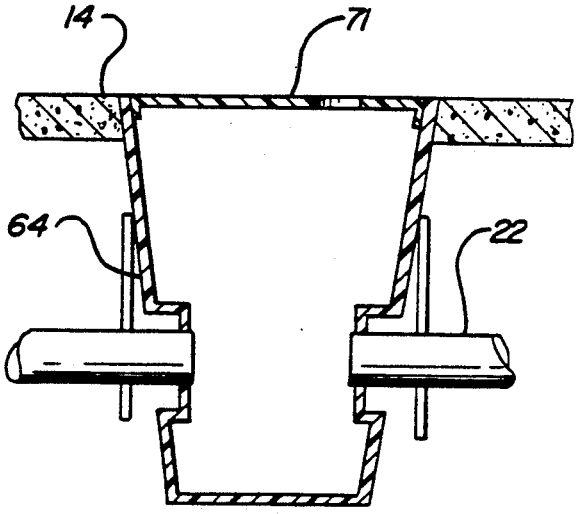
FIG. 8 is a perspective view of the clean-out pipe apparatus of FIG. 7.
Figure 9:
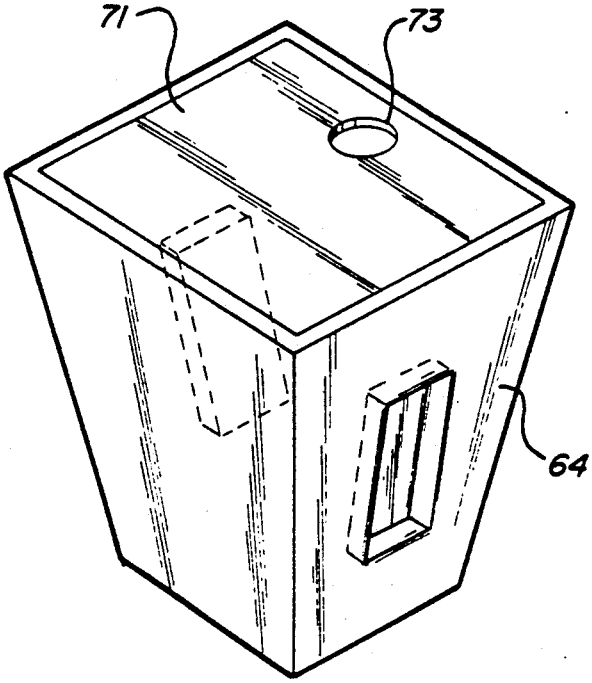
FIG. 9 is an isometric view of the clean-out receptacle depicting a second embodiment of the present invention.

As shown in FIGS. 7 and 8, the clean-out receptacle 64 extends below the level of the piping system 22, and serves as a reservoir for debris flowing therethrough. The clean-out receptacle 64 preferably has a cover plate 71, the cover plate 71 having a knock-out portion 73 for a randon check. Preferably, the clean-out receptacle 64 is truncated and conical in shape, although the clean-out receptacle 64 may also be cubical as shown in FIG. 9. Preferably, the clean-out receptacle 64 extends 24 inches below the flow level, and the cover plate 71 has an 18 inch diameter, and the knock-out 73 has a 4-inch diameter. Generally, the interconnecting piping system extends about 12 inches below the floor level, and the bottom plate of the clean-out receptacle 64 has about a 12-inch diameter.

While the clean-out pipe receptacle 64 has been described in conjunction with a specific embodiment, it is evident that many alternatives, modifications, and variations will be apparent to those skilled in the art in light of the disclosure herein. It is intended that the metes and bounds of the invention be determined by the appended claims rather than by the language of the above specification, and that all such alternatives, modifications, and variations which form a functional or conjointly cooperative equivalent are intended to be included within the spirit and scope of these claims.

We claim:

1. A clean-out receptacle for collecting debris from a drain tile system and a piping system, the piping system being in fluid communication with the drain tile system, the drain tile system and the piping system being disposed in the immediate proximity of a building structure, the building structure having a floor and a lowermost level, the receptacle comprising:

a reservoir in fluid communication with the piping system and the drain tile system, the reservoir being capable of retaining debris deposited therein from the piping system, the reservoir being positioned proximate to a junction between the drain tile system and the piping system to enable essentially direct access to the drain tile system, the reservoir being accessible from the floor of the lowermost level of the building structure.

2. The receptacle of claim 1, wherein the reservoir includes a cover plate.

3. The receptacle of claim 2, wherein the cover plate includes a knock-out portion for a radon check.

4. The receptacle of claim 1, wherein the reservoir extends below the piping system.

5. The receptacle of claim 1, wherein the side walls of the reservoir proximate to the piping system are disposed in a generally vertical orientation.

6. A piping network disposed proximate to a building structure, the building structure having a floor and a lowermost level, the piping network comprising:

(a) a drain tile system disposed about the perimeter of the building structure;

(b) a piping system, at least a portion of the piping system being disposed underneath the building structure, the piping system being in fluid communication with the drain tile system: and (c) a clean-out receptacle being disposed near the junction of the drain tile system and the piping system to enable essentially direct access to the drain tile system, the clean-out receptacle being accessible from the floor of the lowermost level of the building structure.

7. The piping network of claim 6, wherein the clean-out receptacle includes a cover plate.

8. The piping network of claim 7, wherein the cover plate includes a knock-out for a radon check.

9. The piping network of claim 6, wherein the clean-out receptacle extends below the piping system.

10. A system for removing soil gas from the ground proximate to a building structure through a drain tile system, the drain tile system being disposed about the perimeter of the building structure beneath the surface, the drain tile system being in fluid communication with interconnecting pipes, the interconnecting pipes being disposed underneath the building structure, a plurality of junctions being disposed between the drain tile and the interconnection pipes, the system comprising:

(a) a plurality of a clean-out receptacles, each receptacle being disposed proximate to one of the junctions to enable essentially direct access to the drain tile system, each of the clean-out receptacles being in fluid communication with the drain tile system and the interconnecting pipes, each of the clean-out receptacles being accessible from the surface of the building structure;

(b) an air duct system, the air duct system being in fluid communication with one of the clean-our receptacles, the air duct system being vented to the air outside the building structure; and (c) a fan being disposed above the ground level, the fan being disposed proximate to the air duct system, the fan generating a negative pressure whereby soil gas may be drawn into the drain tile system and through the clean-out pipe reservoir and the air duct system by the negative pressure and safely vented to the atmosphere.

11. The system of claim 10, wherein the clean-out receptacles are disposed inside the building structure.

12. The system of claim 10, wherein the air duct system includes quick disconnect means from one of the clean-out receptacles.

13. The system of claim 10, wherein the fan is disposed in the air duct system.

14. The system of claim 10, further comprising a back-up plate disposed outside one of the clean-out receptacles, the back-up plate being positioned in a generally vertical orientation.

* * * * *